US006175339B1

(12) United States Patent
Macon

(10) Patent No.: US 6,175,339 B1
(45) Date of Patent: Jan. 16, 2001

(54) RETRACTABLE ANTENNA CLAMP

(75) Inventor: Jeffrey S. Macon, Burlington, IA (US)

(73) Assignee: Winegard Company, Burlington, IA (US)

( * ) Notice: Under 35 U.S.C. 154(b), the term of this patent shall be extended for 0 days.

(21) Appl. No.: 09/447,698

(22) Filed: Nov. 23, 1999

(51) Int. Cl.[7] ..... H01Q 1/12
(52) U.S. Cl. ..... 343/892; 343/878; 343/880
(58) Field of Search ..... 343/878, 880, 343/882, 883, 890, 891, 892, 715, 765, 766; H01Q 1/12

(56) References Cited

U.S. PATENT DOCUMENTS

| | | | | |
|---|---|---|---|---|
| 4,107,695 | | 8/1978 | Urban | 343/882 |
| 4,500,064 | * | 2/1985 | Calabro | 343/892 |
| 4,595,165 | * | 6/1986 | Klingensmith et al. | 343/892 |
| 4,850,558 | | 7/1989 | Leschot | 248/297.1 |
| 5,173,716 | | 12/1992 | Tetsuka | 343/903 |
| 5,446,472 | * | 8/1995 | Rodeffer | 343/880 |
| 5,570,546 | * | 11/1996 | Butterworth et al. | 343/890 |
| 5,884,890 | * | 3/1999 | Fraley, Jr. | 343/715 |
| 5,929,817 | * | 7/1999 | Clark | 343/713 |

FOREIGN PATENT DOCUMENTS

| | | | |
|---|---|---|---|
| 532960B1 | 6/1996 | (EP) | H01Q/1/24 |

* cited by examiner

*Primary Examiner*—Don Wong
*Assistant Examiner*—Hoang Nguyen
(74) *Attorney, Agent, or Firm*—Dorr, Carson, Sloan & Birney, P.C.

(57) ABSTRACT

A retractable antenna clamp that allows for easy and quick adjustment of an antenna, especially an antenna attached to an RV, boat or camper. The retractable antenna clamp comprises a tension device which holds the antenna shaft in place within a mounting bracket that is attached to a support surface of an RV, camper, boat, or the like. Antenna adjustment is accomplished by releasing the grip of the tension device on the antenna shaft so that the antenna may be raised, lowered or rotated as needed.

20 Claims, 9 Drawing Sheets

Fig. 7B
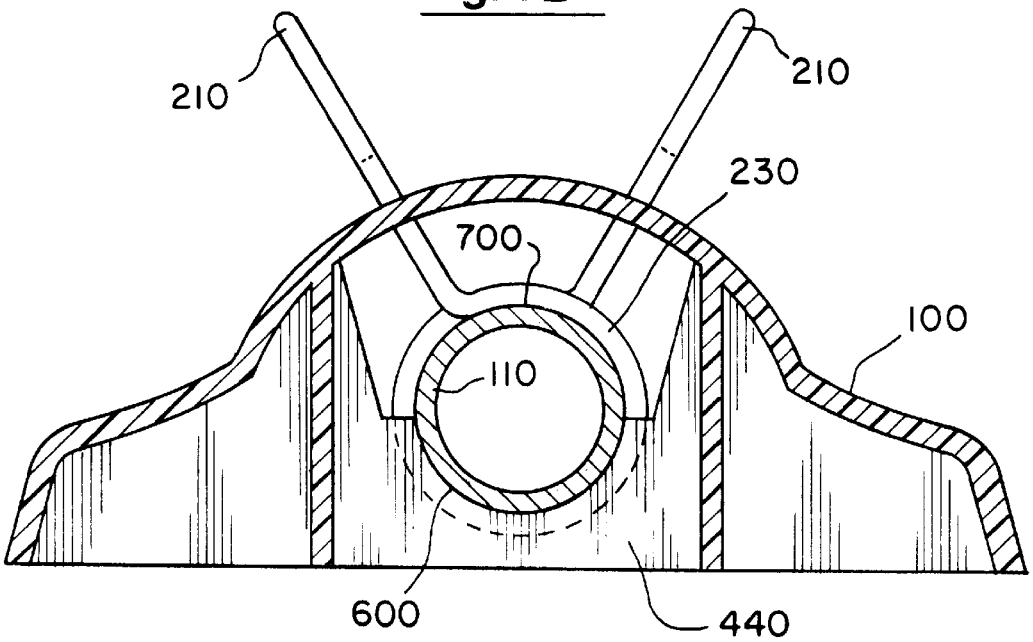
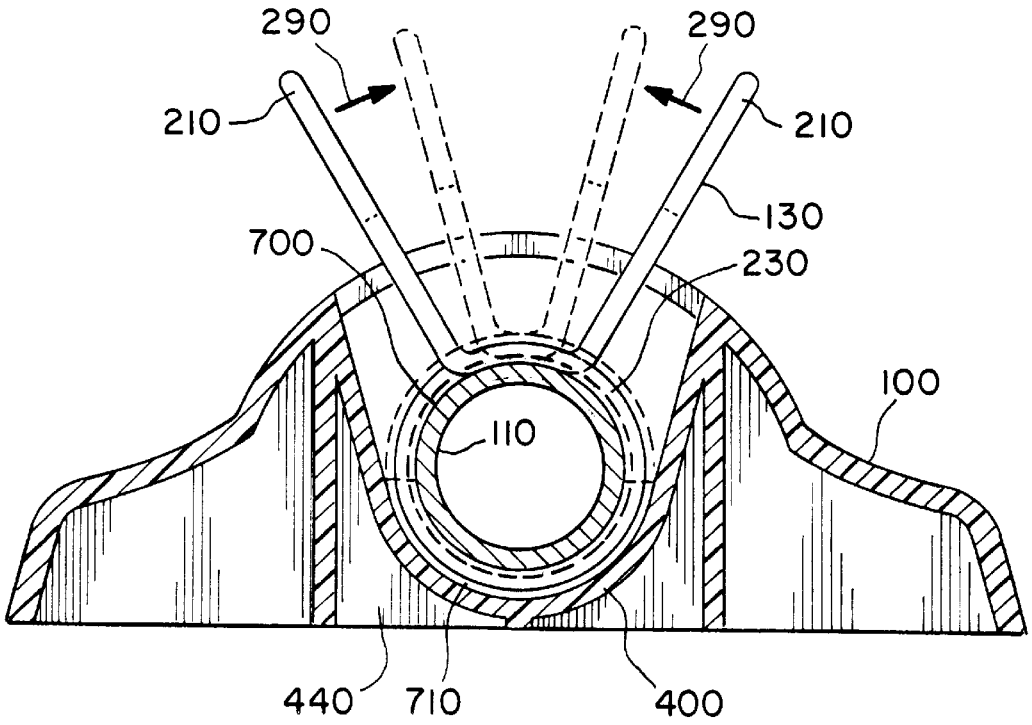
Fig. 7A

RETRACTABLE ANTENNA CLAMP

BACKGROUND OF THE INVENTION

1. Field of the Invention

The present invention relates to a retractable antenna clamp to be used as an adjustment mechanism for an antenna for a television or other electronic device that receives transmitted signals.

2. Statement of the Problem

Over the last several years, the popularity of recreational vehicles such as motor homes, campers and trailers has greatly increased. Out of this popularity, a growing demand for electronic equipment adapted for RV use has emerged. Today, many RVs are equipped with a multitude of electronic devices such as televisions, FM/AM radio receivers, satellite receivers and other electronic devices receiving transmitted signals. To receive these signals, various types of antennas have been developed, but at times, this development has been problematic. Because of the inherent nature of RV use, i.e. travel, a continuing need exists for an adjustment method for RV antennas that is economical, quick, reliable and easy to use.

Unlike stationary antennas which once set, seldom need adjustment, RV antennas require constant adjustment as the vehicle moves from place to place. To this end, several methods of RV antenna adjustment have been developed. Some of these adjustment methods require the manipulation of a hand crank mounted in the ceiling of the RV. Such devices are expensive to obtain and are more prone to failure.

Another concern with these kinds of devices is the type of manipulation required to adjust the antenna. If the manipulation is to be made electrically, then a motor is required which can drain battery power and become problematic in an RV with limited battery reserves, especially if the RV is parked self-contained, without access to electricity.

Even if the crank is manually manipulated, other problems may arise. Since many of the users of recreational vehicles and RV products are oftentimes retirees who may be prone to arthritic conditions which limit their flexibility of movement, the required rotational manipulation of a crank may be prohibitive. Additionally, with a wider socio-economic stratum of consumers entering the RV market, a need exists for an inexpensive, easy to use, highly reliable device for the raising, lowering and rotation of antennas used in RV applications.

A patentability search was directed toward the features of the present invention and this search resulted in the following patents. U.S. Pat. No. 4,850,558 discloses a spring operated emergency brake system to be used on utility poles found at football stadiums, tennis courts, highways and the like. In this device, in the event of a cable brake, the spring decompresses, activating a braking shoe, which stops the rapid descent of a movable carriage positioned alongside the utility pole.

A torsion spring is utilized in U.S. Pat. No. 4,107,695, "Antenna raising and lowering device". In this patent, the torsion spring is adjusted so that the amount of force required to raise or lower the antenna remains constant, despite the type of antenna being utilized. In other words, the spring is not used for antenna adjustment. Instead, the patent uses an actuating handle to rotate a shaft connected to an antenna mount block which when activated, lowers or extends the antenna.

Yet another invention, EP Patent No. 532960, "Hand-held Radio Transceiver with Retractable Rod Antenna" invented by H. Bader and filed Mar. 24, 1993, uses a spring in the retraction and extension of an antenna. However, the spring does not grip the antenna nor does it allow for rotational adjustment of the antenna. Instead, the spring is attached to the end of the antenna and when the antenna is compressed into its receptacle, the spring coils, storing energy so that upon the release of its stored energy, the spring decompresses, extending the antenna.

U.S. Pat. No. 5,173,716 also utilizes a coiled spring element in its telescopic power antenna apparatus. In this device, a coiled spring is used to transmit energy between the drive-side rotary force and the driven-side rotary force of the antenna drive system. In other words, the spring functions as a transmission mechanism rather than as an antenna adjustment means as represented in the present invention. Antenna adjustment is accomplished by means of a motor attached to a worm gear which activates a drive-side base which when rotated, extends and retracts the antenna.

In view of the aforementioned factors as well as a description of the prior art, a need exists for an inexpensive, easy to use, highly reliable and efficient device for the adjustment of antennas, especially those antennas used in RV applications.

SUMMARY OF THE INVENTION

1. Solution to the Problem.

The present invention provides for a retractable antenna clamp to be used as an adjustment device for economical, reliable, quick and easy manipulation of an antenna (particularly those antennas used in RV applications). Because of the elegance and simplicity of its design, the invention is extremely reliable and solves the aforementioned needs. Additionally, the present invention eliminates the need for hand cranking, a manipulation difficult to perform for consumers with impaired flexibility. Furthermore, the present invention does not drain battery reserves, an ever-present concern for users of RVs. Lastly, because of its low cost, the present invention provides a much-needed alternative for those unable to afford the market's conventional, higher priced adjustment devices.

2. Summary.

The present invention discloses a retractable antenna clamp positioned in a mounting bracket through which the shaft of an antenna such as a TV or satellite dish antenna is disposed. The invention may be easily installed by affixing the mounting bracket of the invention to a vertical support surface such as the side of an RV, boat, camper and the like.

In the preferred embodiment, the antenna clamp comprises a tension device which is in the shape of a spring having a central coil with a formed circular opening. When the central coil is in a relaxed state, the formed circular opening of the central coil grips the shaft, firmly holding the shaft and antenna in place within the mounting bracket.

When antenna adjustment is required, adjustment may be accomplished by releasing the grip of the tension device on the antenna shaft. In the preferred embodiment, the grip of the tension device on the antenna shaft is released by squeezing together two opposing handles attached to the tension device. When the handles are compressed, the central coil of the tension device expands, thereby releasing its grip on the antenna shaft so that the antenna may be raised, lowered or rotated as desired. Once adjustment is accomplished, the opposing handles are released and the central coil of the tension device relaxes, once again gripping the shaft so that the shaft and its attached antenna are held firmly in place within the mounting bracket.

BRIEF DESCRIPTION OF THE DRAWINGS

FIGS. 7A & 7B are cross sectional views of the mounting bracket with the antenna shaft positioned inside the bracket and disposed through the tension device and support structure.

DETAILED DESCRIPTION OF THE INVENTION

1. Overview.

Figure 1:
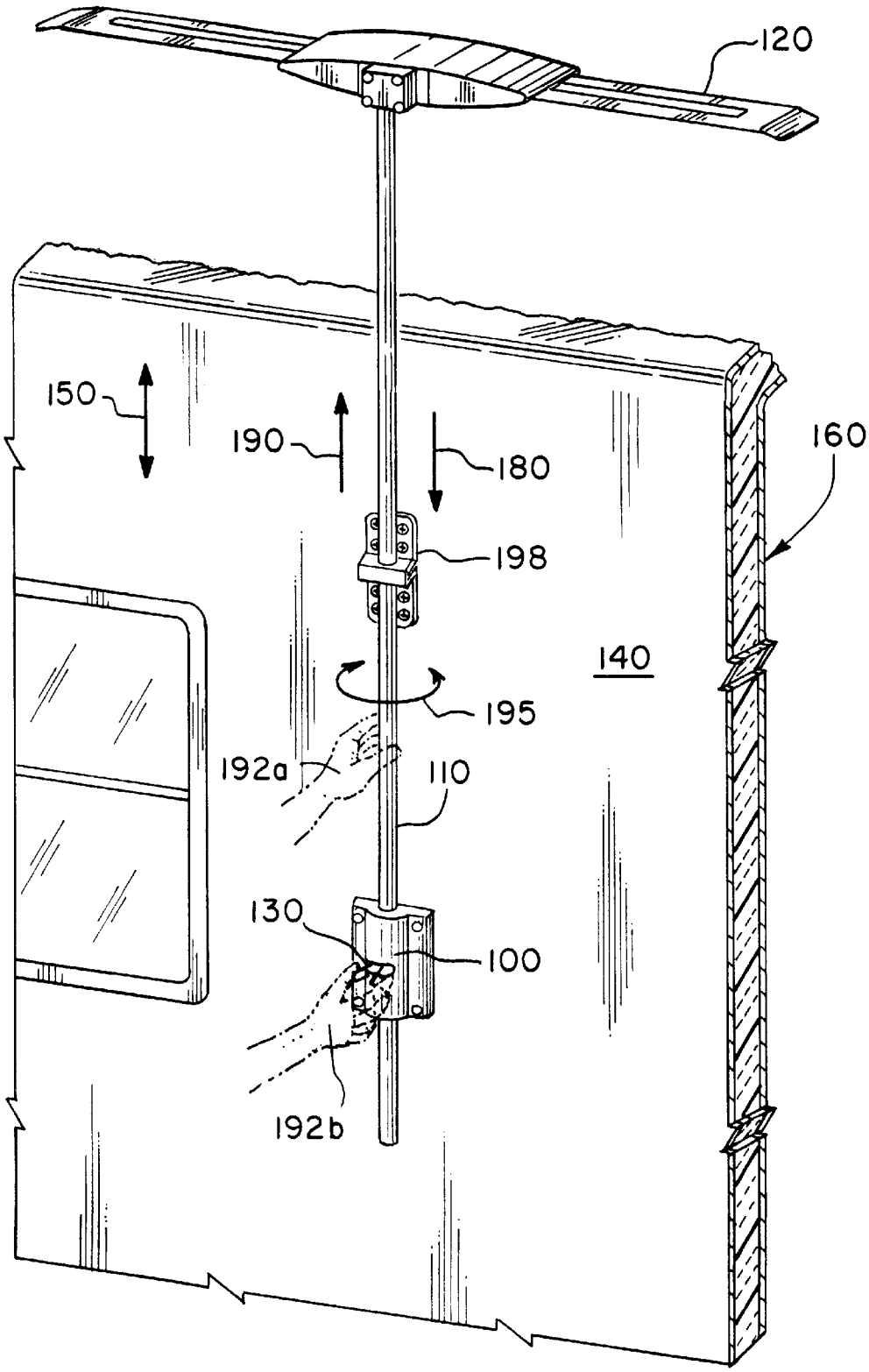
FIG. 1 is a perspective view of the antenna and the retractable antenna clamp assembly that raises and lowers the antenna.

An invention for quickly and easily adjusting an antenna 120 which is conventionally connected to a shaft 110 is shown in FIG. 1. It should be noted that the present invention could be used with any type of antenna 120. Even though a television antenna 120 is depicted in FIG. 1, the present invention could be used for adjusting any kind of antenna such as a satellite dish, radio or citizen band antenna. The present invention can also be used for any type of antenna application. Although it is especially suited for use in recreational vehicles (RVs), the proposed invention could be used for the adjustment of antennas installed in homes, apartments, boats, trailers and the like.

As illustrated in FIG. 1, the invention comprises a tension device 130, positioned in a mounting bracket 100 through which the shaft 110 of the antenna 120 is disposed. The tension device 130 grips the shaft 110 and holds R in position within the mounting bracket 100 until adjustment of the antenna 120 is required. In FIG. 1, the invention is easily installed by affixing the mounting bracket 100 to a support surface 140. In the preferred embodiment, a mounting brace 198 through which the shaft 110 is disposed is also affixed to the support surface 140 above the mounting bracket 100 to provide additional support for the shaft 110 and its attached antenna 120. Even though the support surface 140 utilized in FIG. 1 is vertical 150 and comprises the side 160 of perhaps an RV or a trailer, any orientation or type of support surface 140 can be used as long as it provides for secure attachment of the mounting bracket 100 and mounting brace 198.

Whether mounted to the side 160 or other parts of a support surface 140, the antenna 120 can be raised 190, lowered 180 or rotated 195 by hand 192*a* when the grip of the tension device 130 on the shaft 110 is released. In the preferred embodiment depicted in FIGS. 1–8, the tension device's 130 grip on the shaft 110 is released when the tension device's 130 opposing handles 210 shown projecting through an opening 230 in the mounting bracket 100 are squeezed together by hand 192*b* in the direction of the arrows 290 as illustrated in the preferred embodiment shown in FIGS. 1 and 2.

When the opposing handles 210 are compressed together, the tension device 130 releases the shaft 110 and the antenna 120 may be easily raised 190, lowered 180 or rotated 195 by hand 192*a* as indicated in FIG. 1. Once adjustment is made, the opposing handles 210 are released and the tension device 130 regrips the shaft 110, once again holding the shaft 110 firmly in place within the mounting bracket 100.

It should be appreciated that the present invention is not limited to the use of opposing handles 210 to release the grip of the tension device 130 on the shaft 110. The proposed invention is meant to incorporate any other means of tension device 130 release in addition to that presented in the preferred embodiment.

2. Mounting Bracket.

Figure 2:
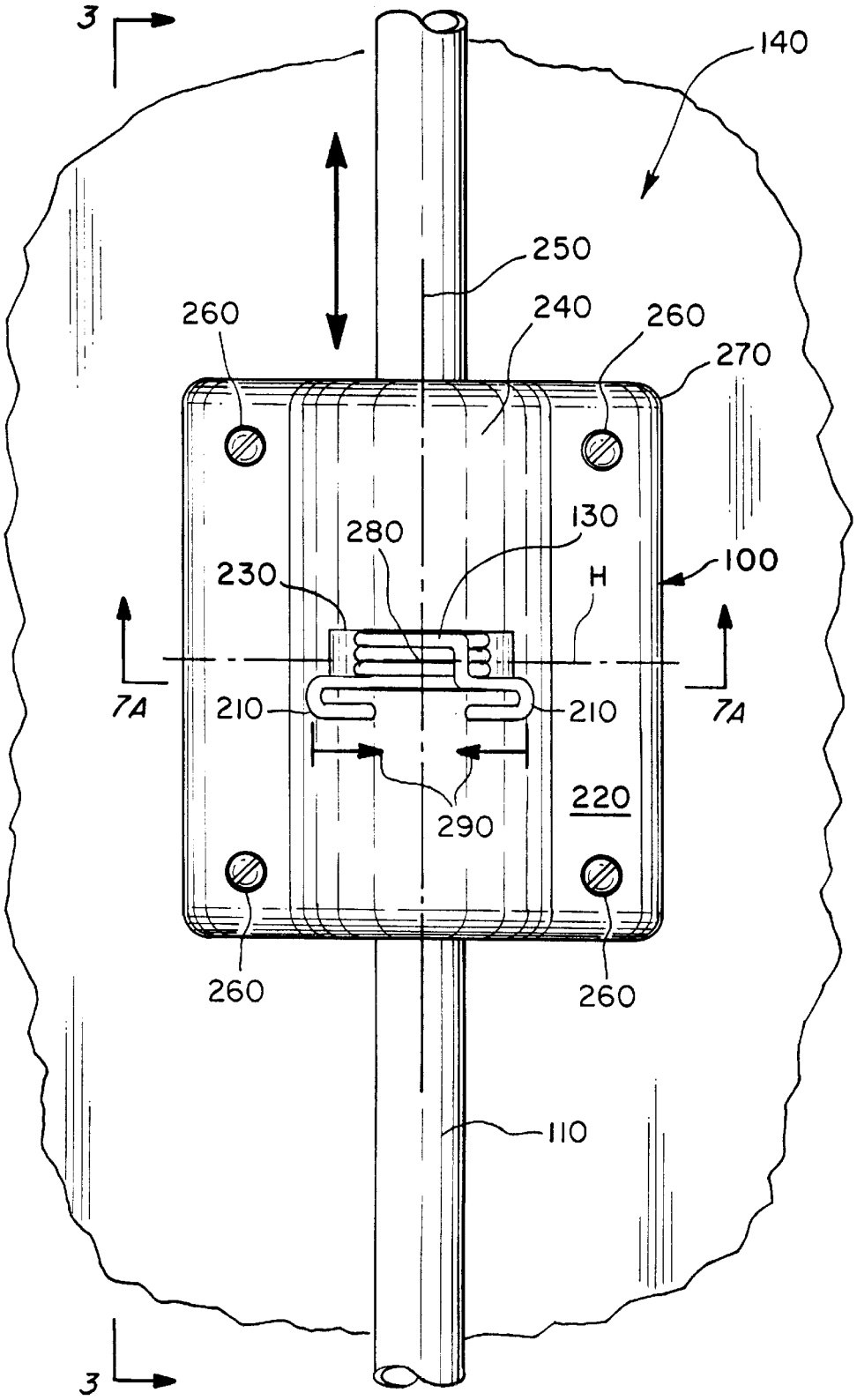
FIG. 2 is an outer surface perspective view of the mounting bracket with the retractable antenna clamp positioned within the mounting bracket.

Details of the mounting bracket 100 of the preferred embodiment are depicted in FIGS. 1–7. In FIG. 2, an outer surface 220 view of the mounting bracket 100 is presented. In the preferred embodiment illustrated in FIG. 2, the mounting bracket 100 is substantially rectangular in shape and has an elongated raised portion 240 disposed down the centerline 250 of the mounting bracket 100. Four holes 260 in each of the four comers 270 of the mounting bracket 100 are shown in FIGS. 2–7 for affixation of the mounting bracket 100 to a support surface 140. An opening 230, substantially rectangular in shape and centrally 280 located within the mounting bracket 100, is also shown in FIG. 2.

In FIG. 2, the tension device 130 is positioned behind the opening 230 of the mounting bracket 100 and the opposing handles 210 of the tension device 130 project through the opening 230 to the outer surface 220 of the mounting bracket 100. When the opposing handles 210 are pinched together in the direction of the arrows 290, the tension device 130 releases its grip on the shaft 110 so that the antenna 120 may be raised, lowered or rotated. Alternatively, when the opposing handles 210 are released, the tension device 130 regrips the shaft 110, once again holding the shaft 110 firmly in place within the mounting bracket 100 as shown in FIG. 2.

Figure 3:
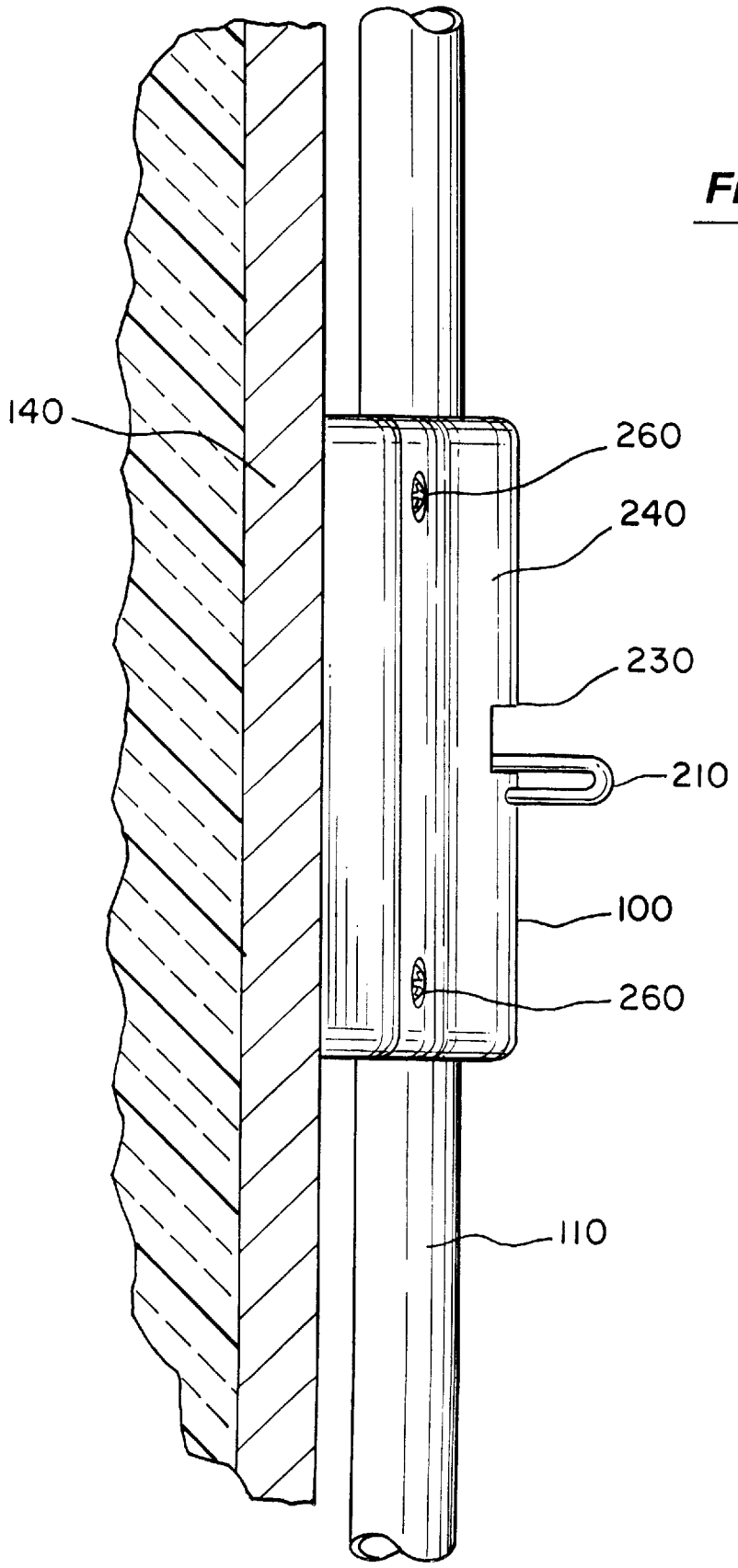
FIG. 3 is a side perspective view of the mounting bracket with the opposing handles of the retractable antenna clamp protruding through the mounting bracket.

FIG. 3 represents a side view of the preferred embodiment of the mounting bracket 100. Again, the opposing handles 210 of the mounting bracket 100 may be seen projecting through the opening 230 of the mounting bracket 100.

Figure 4:
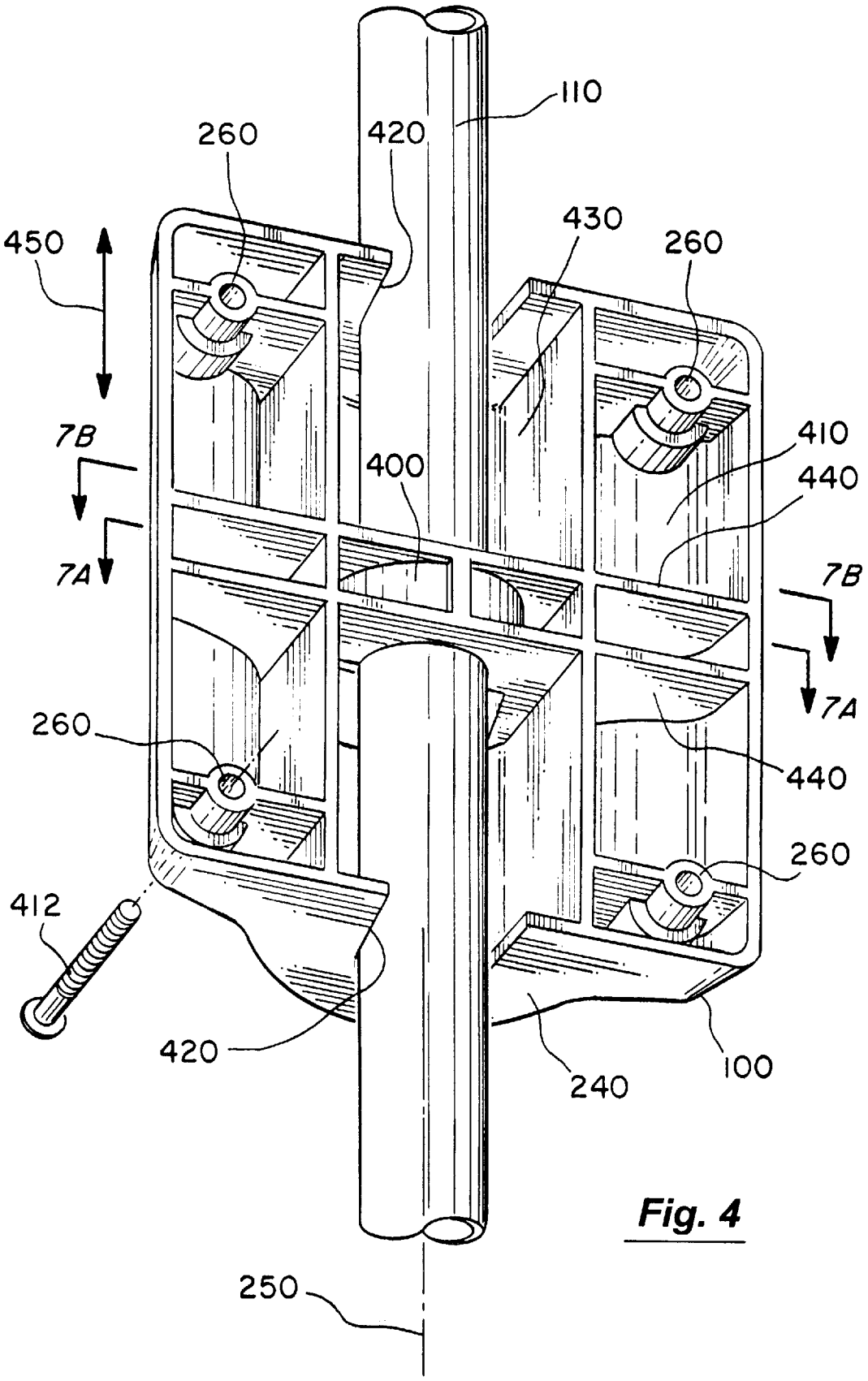
FIG. 4 is an inner surface perspective view of the mounting bracket and the shaft positioned within the mounting bracket.

FIG. 4 presents an inner surface 410 view of the mounting bracket 100. A fastening device 412 is used in each hole 260 to mount the bracket 100 to the support surface 140. In the preferred embodiment, the elongated raised portion 240 of the mounting bracket 100 forms a cavity 430 down the centerline 250 inner surface 410 of the mounting bracket 100. As illustrated in FIG. 4, the shaft 110 is positioned inside the cavity 430.

FIG. 4 also depicts a support structure 400 attached to the inner surface 410 of the mounting bracket 100. In the illustration, the shaft 110 is disposed through the support structure 400. In the preferred embodiment, the support structure 400 is centrally located and positioned behind the opening 230 of the mounting bracket 100. Additionally in the preferred embodiment, two support baffles 440 sandwich the support structure 400. In the preferred embodiment, the support structure 400 is a continuous formed part of the support baffles 440 but it is to be expressly understood that other designs of the support structure 400 and support baffles 440 may be used. In other words, the support baffles 440 may sandwich and support the support structure 400 without the support structure 400 being a continuous formed part of the support baffles 440 as illustrated in FIG. 4. In fact, the support baffles 440 are optional under the teachings of the present invention.

Additionally in the preferred embodiment of FIG. 4, the support baffles 440 are centrally located and are positioned at right angles to the vertical length 450 of the mounting bracket 100. These support baffles 440 add additional strength to the support structure 400 so that the shaft 110 and its attached antenna 120 may be held even more firmly in place within the mounting bracket 100.

Figure 5:
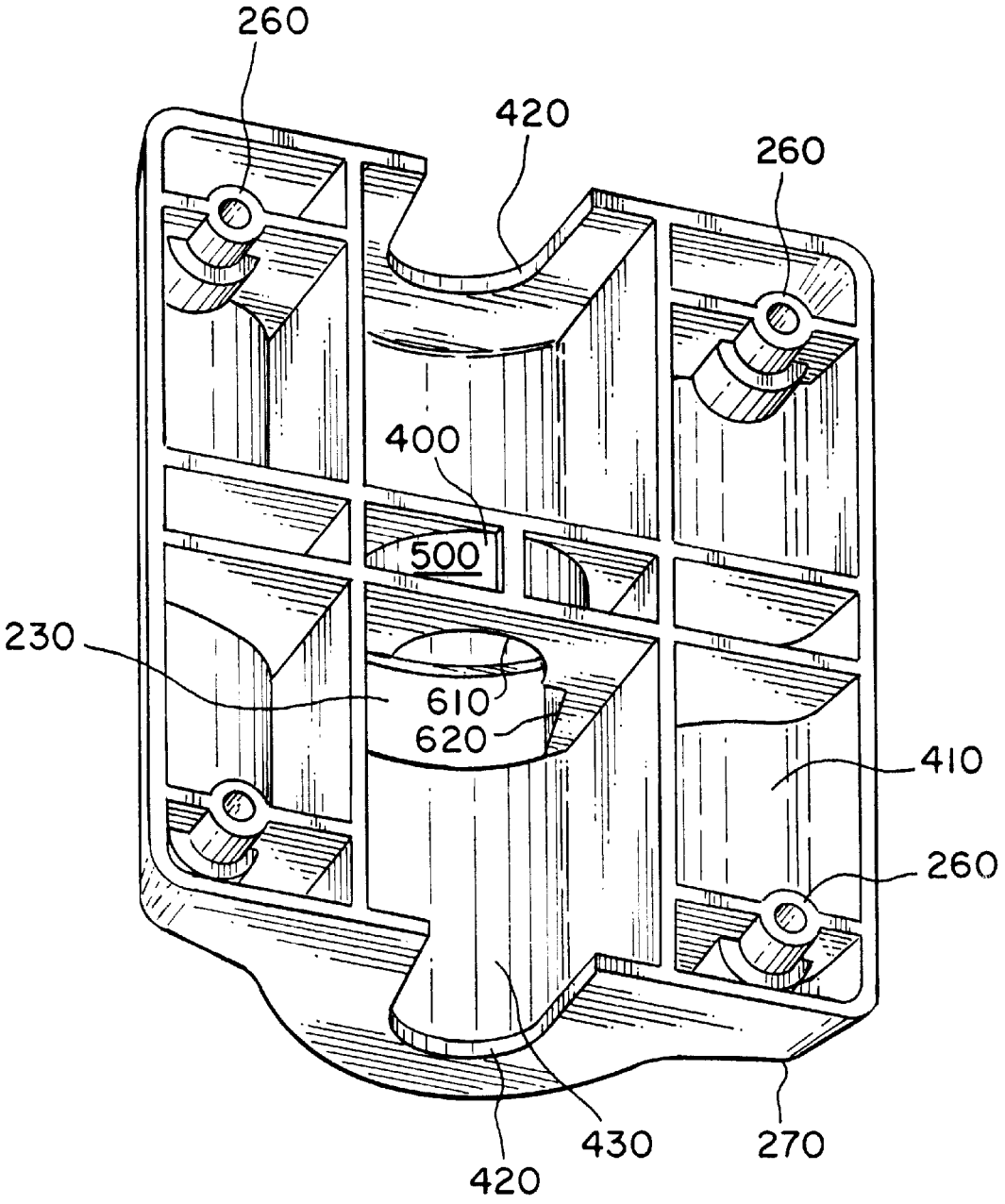
FIG. 5 is an inner surface perspective view of the mounting bracket.

FIG. 5 represents an inner surface 410 view of the mounting bracket 100 with the shaft 110 removed. It should be noted that in the preferred embodiment shown in FIG. 5, the support structure 400 comprises a U-shaped sleeve 500, however other designs of the support structure 400 may be used in different embodiments of the invention. In other words, the support structure 400 may be of any suitable shape such as oval, circular, etc., that will allow for free rotation of the shaft 110. Additionally in other embodiments, the support structure 400 may be positioned anywhere between the top and bottom of the mounting bracket 100.

Figure 6:
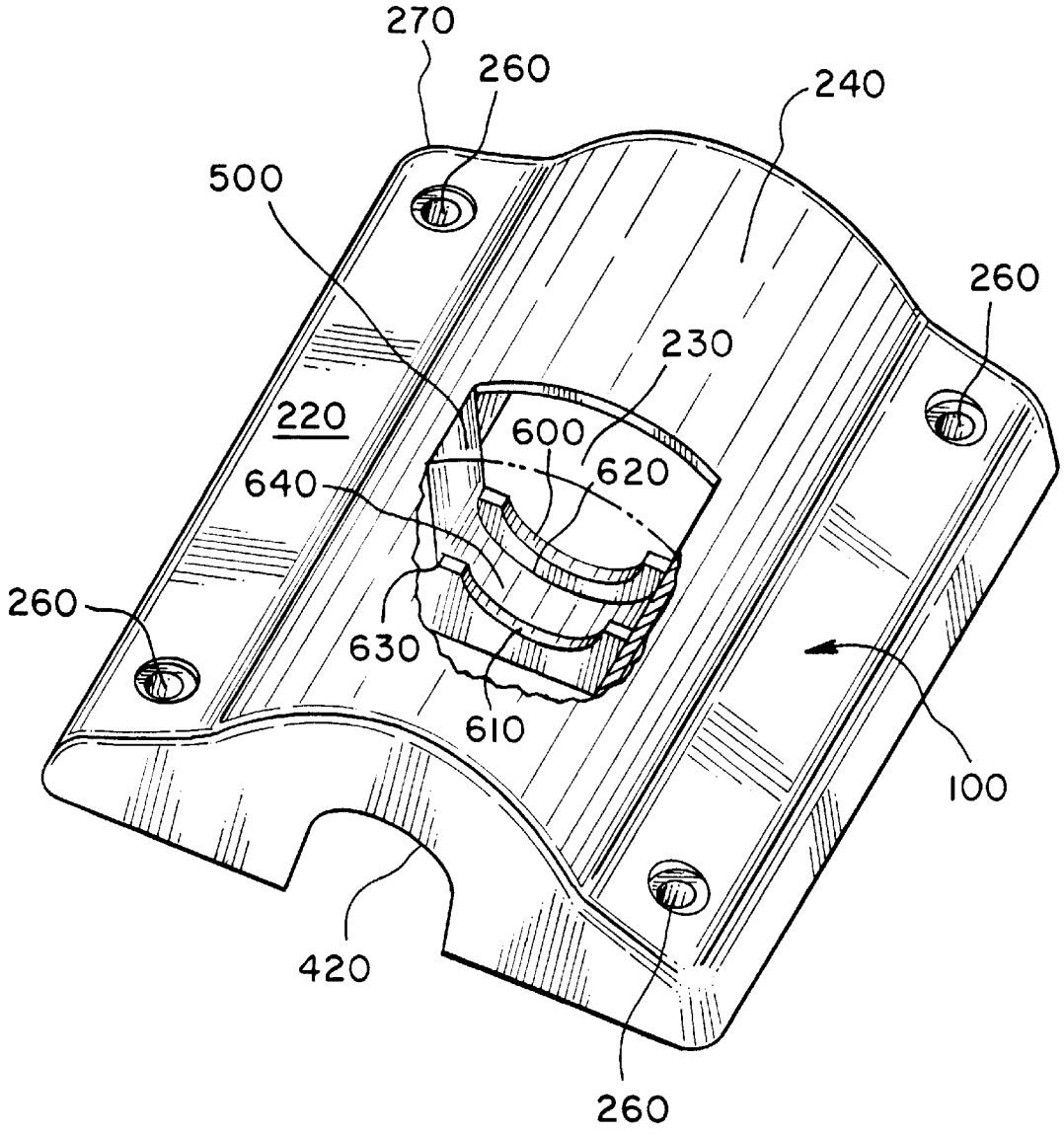
FIG. 6 is an outer surface perspective view of the mounting bracket.

FIG. 6 details an outer surface 220 perspective view of the mounting bracket 100. In the preferred embodiment illustrated in this figure, an upper and lower lip 600, 610 is formed on the upper and lower edges 620, 630 of the concave surface 640 of the U-shaped sleeve 500. In the preferred embodiment, the tension device 130 is positioned between the upper and lower lips 600, 610 of the U-shaped sleeve 500 so that the tension device 130 and the shaft 110 disposed through it may be held even more firmly in place within the mounting bracket 100. It should also be noted that the disclosed invention is meant to encompass other designs of the lips 600, 610 on the U-shaped sleeve 500 and that the lips 600, 610 are optional under the teachings of the present invention.

In the mounting bracket 100 depicted in FIGS. 4, 5 and 6, the mounting bracket 100 has two opposing openings 420 for positioning of the shaft 110. In the preferred embodiment of the mounting bracket 100, the opposing openings 420 are U-shaped and extend in a direction opposite the U-shaped sleeve 500.

FIGS. 7A and 7B present a cross-sectional view of the mounting bracket 100. As illustrated in the preferred embodiment, the support structure 400 holds the tension device 130 in position within the mounting bracket 100. The support structure 400 also includes an upper lip 600 and a lower lip 610 (not shown in FIG. 7B) between which the tension device 130 rests.

As illustrated in FIG. 7A, when the tension device 130 is in a relaxed state (as shown by the solid lines), the tension device 130 tightly grips 700 the entire circumference of the shaft 110. When antenna 120 adjustment is required, the opposing handles 210 projecting through the opening 230 are pinched together in the direction of the arrows 290. This action releases the grip 700 of the tension device 130 (as shown by the dotted lines) on the shaft 110 so that the antenna 120 may be freely raised, lowered or rotated. As shown in FIG. 7A, there is sufficient clearance 710 for the shaft 110 to freely rotate and move within the tension device 130 when the grip 700 of the tension device 130 is released.

It should be noted that in this preferred embodiment, the support structure 400 is a formed continuous part of the support baffles 440 but as previously stated, in the teachings of the present invention, the support baffles 440 are optional. If the support baffles 440 are included, other designs and placements of the support baffles 440 may be utilized in the disclosed invention.

It should be further appreciated that the shape of the mounting bracket 100 of the present invention is not limited to the preferred embodiment. Configurations other than rectangular, such as square, circular, oval, etc., may be used in its design. Additionally, other methods of affixation, such as clamps, hooks, etc., may be utilized to attach the mounting bracket 100 to the support surface 140.

In other embodiments of the mounting bracket 100, the opening 230 of the mounting bracket 100 may be of any suitable shape such as square, oval, etc., and may be positioned anywhere between the top and bottom of the mounting bracket 100. Additionally in alternative embodiments, the opposing openings 420 for placement of the shaft 110 may be of any appropriate design such as circular, oval, etc., that will allow for free rotation of the shaft 110 within the mounting bracket 100. Likewise as previously stated, the support structure 400 and support baffles 440 may be positioned anywhere between the top and bottom of the mounting bracket 100 and the support structure 400 shape may be of any suitable design such as oval, circular, etc., that will allow for free rotation of the shaft 110.

3. Tension Device.

Figure 8:
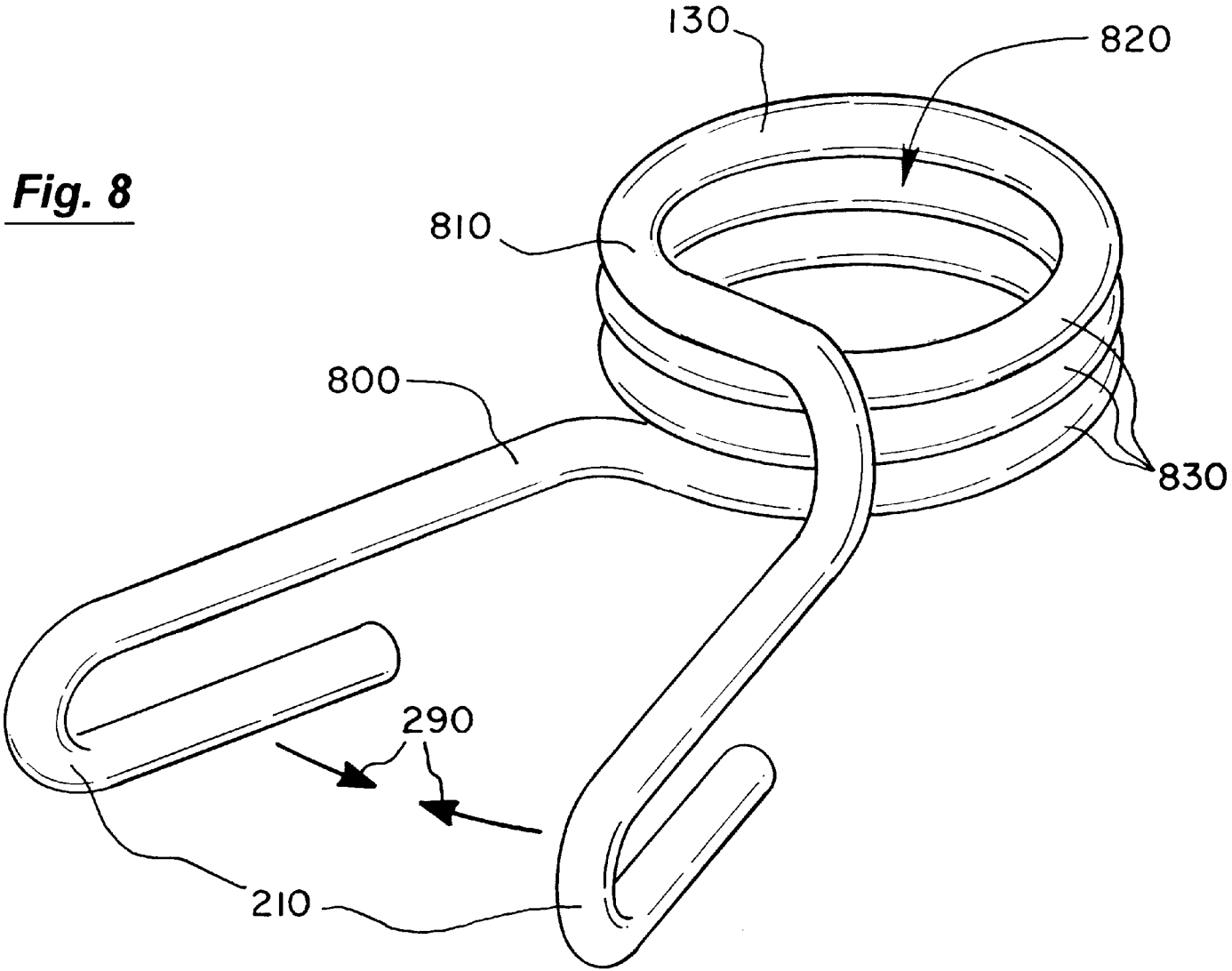
FIG. 8 is a perspective view of the tension device.

A detailed perspective view of the tension device 130 is illustrated in FIG. 8. In the preferred embodiment of the invention, the tension device 130 comprises a spring 800 which has a central coil 810 with a number of turns 830 that form a circular opening 820. The formed circular opening 820 of the central coil 810 grips the shaft 110 when the central coil 810 is in a relaxed state.

As shown in FIG. 8, the spring 800 also has two opposing handles 210 for compression of the spring 800 and subsequent release of the shaft 110. In the preferred embodiment, the handles 210 are U-shaped to permit easy and quick compression of the spring 800. it should be noted that the invention is not limited to U-shaped opposing handles 210. Other designs of handles such as tabs, hooks, etc., may be utilized in alternative embodiments of the invention.

In the preferred embodiment of the tension device 130, the opposing handles 210 of the spring 800 project through the opening 230 to the outer surface 220 of the mounting bracket 100 as shown in FIGS. 2 and 3. When the handles 210 are compressed together in the direction of the arrows 290, the central coil 810 releases its grip 700 on the shaft 110 so that the antenna 120 may be raised, lowered or rotated as shown in FIG. 7A. Alternatively, when the spring 800 is in a relaxed state, the central coil 810 regrips the shaft 110 so that the shaft 110 and its attached antenna 120 are held firmly in place within the mounting bracket 100.

4. Mounting Brace.

Figure 9:
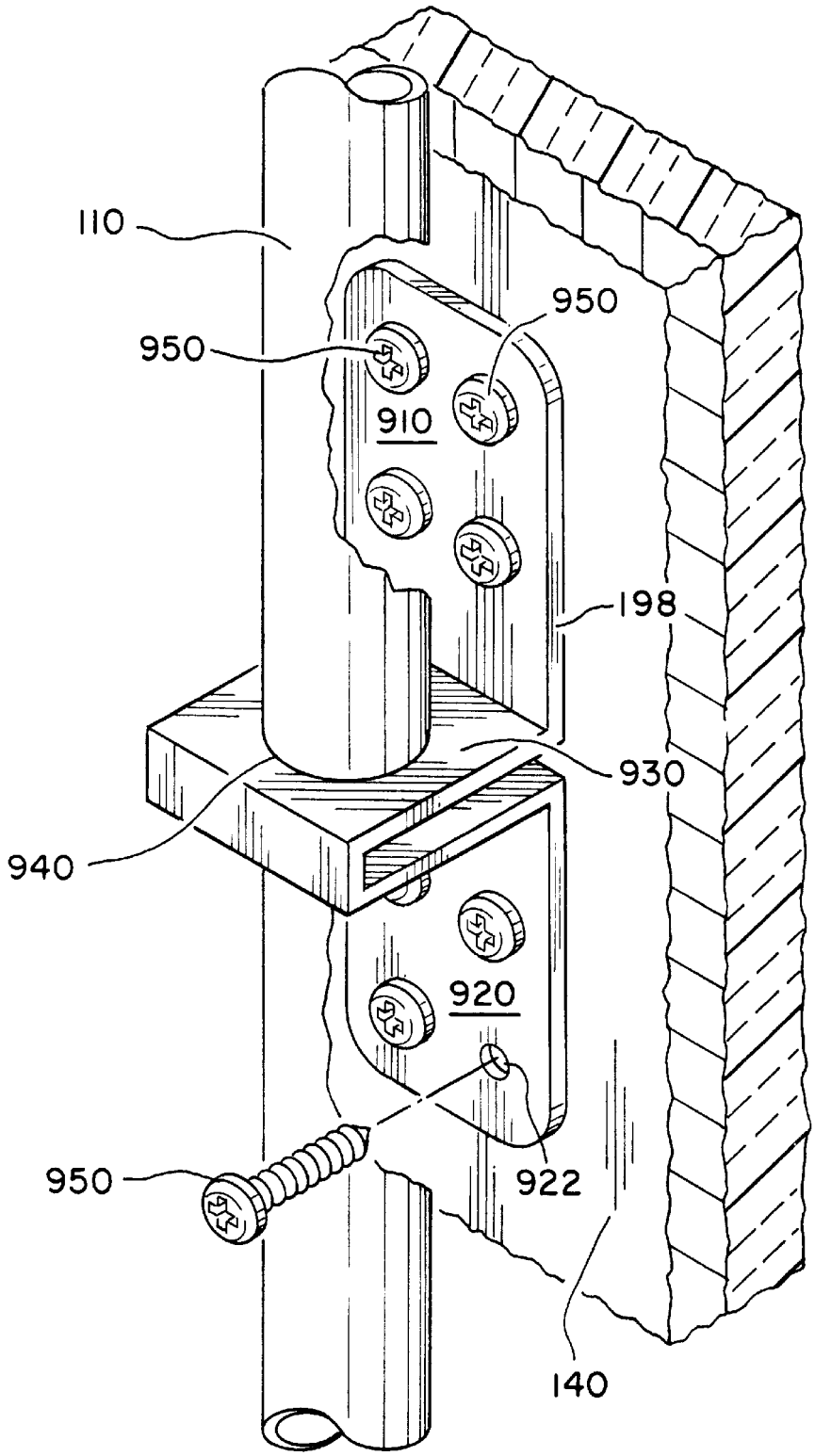
FIG. 9 is a perspective view of the mounting brace.

In the preferred embodiment, a mounting brace 198 provides additional support for the shaft 110 as detailed in FIG. 9. As depicted, the brace 198 comprises one continuous formed shape that includes an upper tab 910, a lower tab 920 and a platform 930 positioned between the upper and lower tabs 910, 920. As shown, an opening 940 is formed in the platform 930 for positioning of the shaft 110 through the opening 940. In the preferred embodiment, the opening 940 is circular, however other shaped openings may be utilized as long as the shaft 110 can freely rotate and yet be supported within the opening 940. Also as shown, four holes 922 are positioned in each of the upper and lower tabs 910, 920 to allow for attachment 950 of the brace 198 to the support surface 140 with a device such as a screw.

In the preferred embodiment shown in FIG. 1, the brace 198 is mounted to a support surface 140 and positioned above the mounting bracket 100 to provide additional support for the antenna 120 and shaft 110. However it is to be expressly understood that other placements of the mounting brace 198 may be utilized in the disclosed invention. It should also be noted that other mounting brace 198 designs such as oval, rectangular, square etc., may be used in different embodiments of the invention. In fact in some embodiments, the brace 198 may be entirely omitted from the embodiment and still be within the scope of the disclosed invention. Additionally, other means of attachment 950 such as clamps, hooks etc., may be utilized to affix the brace 198 to the support surface 140.

The foregoing discussion of the invention has been presented for purposes of illustration and description. Further, the description is not intended to limit the invention to the form disclosed herein. Consequently, variations and modifications commensurate with the above teachings and within the skill and knowledge of the relevant art are within the scope of the present invention. The embodiment described herein is further intended to explain the best mode presently known of practicing the invention and to enable others skilled in the art to utilize the invention as such, or in other embodiments, and with the various modifications required by their particular application or uses of the invention. It is intended that the appended claims be construed to include alternate embodiments to the extent permitted by the prior art.

I claim:

1. An apparatus for raising, lowering and rotating an antenna mounted on a shaft in relation to a support surface, said apparatus comprising:

a mounting bracket attached to the support surface, said mounting bracket holding the shaft; and a tension device held by said mounting bracket, said tension device disposed around the shaft, said tension device gripping the shaft when said tension device is in a relaxed state so as to firmly hold the shaft in relation to the support surface, said tension device releasing the shaft when said tension device is in a biased state.

2. The apparatus of claim 1 wherein said mounting bracket has two opposing openings, the shaft disposed through said opposing openings.

3. The apparatus of claim 1 wherein said mounting bracket has a top and bottom, said mounting bracket further having a support structure attached between said top and bottom of said mounting bracket, the shaft disposed through said support structure of said mounting bracket.

4. The apparatus of claim 1 wherein said tension device comprises a spring, said spring having a central coil with a formed circular opening receptive of the shaft, said formed circular opening gripping the shaft when said central coil is in a relaxed state, said spring further having two opposing handles so that when said opposing handles are pinched together, said central coil releases the shaft so that the antenna may be raised, lowered and rotated.

5. The apparatus of claim 1 wherein said mounting bracket is substantially rectangular in shape.

6. The apparatus of claim I wherein said mounting bracket has an elongated raised portion, said elongated raised portion forming a cavity in said mounting bracket for positioning of the shaft.

7. The apparatus of claim 1 wherein said mounting bracket has two U-shaped opposing openings, the shaft disposed through said U-shaped opposing openings.

8. The apparatus of claim 1 further having a top and bottom and a U-shaped sleeve attached between said top and bottom of said mounting bracket, the shaft disposed through said U-shaped sleeve.

9. The apparatus of claim 1 wherein said mounting bracket has a top and bottom, said tension device positioned between said top and bottom of said mounting bracket.

10. The apparatus of claim 1 wherein said mounting bracket has an opening, said tension device of said mounting bracket having two opposing handles projecting through said opening so that when said opposing handles are pinched together, said tension device releases the shaft so that the antenna may be raised, lowered and rotated.

11. An apparatus for raising, lowering and rotating an antenna mounted on a shaft in relation to a support surface, said apparatus comprising:

a mounting bracket attached to the support surface, said mounting bracket having an opening, said mounting bracket further having two opposing openings, the shaft disposed through said opposing openings; and a spring, said spring having a central coil with a formed circular opening, said formed circular opening receptive of the shaft, said central coil gripping the shaft when said central coil is in a relaxed state, said central coil releasing the shaft when said central coil is in a biased state so that the antenna may be raised, lowered and rotated.

12. The apparatus of claim 11 wherein said mounting bracket has a top and bottom, said mounting bracket further having a support structure attached between said top and bottom of said mounting bracket, the shaft disposed through said support structure of said mounting bracket.

13. The apparatus of claim 11 wherein said opposing openings are U-shaped, the shaft disposed through said U-shaped opposing openings.

14. The apparatus of claim 11 wherein said mounting bracket has an inner surface, said mounting bracket further having an elongated raised portion, said elongated raised portion forming a cavity on said inner surface for positioning of the shaft.

15. The apparatus of claim 11 wherein said spring has two opposing handles, said opposing handles projecting through said opening of said mounting bracket so that when said opposing handles are pinched together, said central coil releases the shaft so that the antenna may be raised, lowered and rotated.

16. The apparatus of claim 11 wherein said mounting bracket has a top and bottom, said mounting bracket further having a U-shaped sleeve attached between said top and bottom of said mounting bracket, the shaft disposed through said U-shaped sleeve.

17. The apparatus of claim 11 wherein said opening is centrally located, said spring of said mounting bracket positioned behind said central opening of said mounting bracket.

18. The apparatus of claim 11 wherein said mounting bracket has a top and bottom, said spring of said mounting bracket positioned between said top and bottom of said mounting bracket.

19. An apparatus for raising, lowering and rotating an antenna mounted on a shaft in relation to a support surface, said apparatus comprising:

a mounting bracket attached to the support surface, said mounting bracket having inner and outer surfaces, said mounting bracket having an elongated raised portion, said elongated raised portion forming a cavity on said inner surface, said elongated raised portion having opposing ends formed into U-shaped openings, said mounting bracket having a formed U-shaped sleeve centrally located in said cavity, said U-shaped sleeve having a concave surface and upper and lower edges, said U-shaped sleeve extending in a direction opposite said U-shaped openings of said opposing ends, said U-shaped sleeve having a formed upper and lower lip on said upper and lower edges of said concave surface of said U-shaped sleeve, said upper and lower lips engaging the shaft to provide support, said mounting bracket also having an opening formed opposite said U-shaped sleeve, the shaft disposed through said U-shaped openings and said U-shaped sleeve; and a spring, said spring having a central coil with a formed circular opening and two opposing handles, said spring positioned between said upper and lower lips of said U-shaped sleeve of said mounting bracket, said central coil of said spring located between said U-shaped sleeve and said opening of said mounting bracket, said formed circular opening of said central coil receptive of the shaft and said formed circular opening exerting tension on the shaft when said central coil is in a relaxed state to firmly hold the shaft in said mounting bracket, said handles of said spring projecting through said opening of said mounting bracket and extending beyond said outer surface of said mounting bracket so that when said handles are pinched together, said central coil of said spring disengages the shaft so that the antenna may be raised, lowered and rotated.

20. The apparatus of claim 19 further including a mounting brace attached to the support surface, said mounting brace having an upper and lower tab, said mounting brace also having a platform positioned between said upper and lower tabs, said platform having a formed opening for positioning of the shaft through said formed opening, said brace providing additional support for the shaft and antenna.

* * * * *